United States Patent [19]

Dayus

[11] Patent Number: 4,545,294

[45] Date of Patent: Oct. 8, 1985

[54] FRICTIONAL BLADE ASSEMBLY FOR GRILLE

[76] Inventor: Lloyd G. Dayus, 1735 Mattawa Ave., Mississauga, Ontario, Canada, L4X 1K5

[21] Appl. No.: 554,078

[22] Filed: Nov. 21, 1983

[51] Int. Cl.[4] ..... F24F 13/08

[52] U.S. Cl. ..... 98/110; 98/121.1; 98/121.2

[58] Field of Search ..... 98/40 V, 110, 114, 121; 137/601

[56] References Cited

U.S. PATENT DOCUMENTS

| | | | |
|---|---|---|---|
| 3,426,667 | 2/1969 | Johnson | 98/121 R X |
| 3,691,687 | 9/1972 | Economou | 98/121 A X |
| 3,793,932 | 2/1974 | Tarnoff | 98/121 A X |
| 3,800,688 | 4/1974 | Parrish | 98/110 X |
| 4,103,601 | 8/1978 | Dayus | 98/114 X |
| 4,192,098 | 3/1980 | Brzezinski | 98/121 A X |

*Primary Examiner*—Harold Joyce
*Attorney, Agent, or Firm*—George A. Rolston

[57] ABSTRACT

The invention comprises a grille blade, a frictional blade assembly for grilles using blades, and a grille assembly using blades, each blade defining a first and second end and upper and lower sides, being of uniform cross-sectional shape and size along its length, each blade defining a generally streamline-shaped tube, the tube defining a first edge, a second edge and an internal space and being formed from an integral sheet of relatively thin material, whereby the sheet is bent back upon itself and one sheet edge is secured below another, the internal space at the first edge being of generally circular cross-section over an arc of approximately 270°, a circular cross-section having a diameter of between 0.002" and 0.004" less than that of abutments over which the blades are to be rotatably attached.

25 Claims, 10 Drawing Figures

FRICTIONAL BLADE ASSEMBLY FOR GRILLE

This invention relates to a frictional blade assembly for an air grille for use in association with air ventilation systems.

BACKGROUND OF THE INVENTION

Conventional air grilles generally comprise a rectangular metal frame and a number of parallel transverse blades rotatably mounted to the frame. The blades are generally secured by friction in a particular angular position with respect to the frame and to the flow of air.

Several embodiments of such typical grilles are disclosed in U.S. Pat. No. 4,103,601. However, conventional means for achieving a tight frictional fit between blade and the frame may suffer from one of two disadvantages. First, if the blade length is increased, for instance in the event that a wider air duct is used, the friction torques may be inadequate to resist the torque exerted on the blades by the pressure of the air moving in the duct. Consequently, the blade may be rotated away from the desired angular position. Second, a means for achieving an adequate frictional fit may be expensive to manufacture and install. For instance, the embodiments illustrated in FIGS. 1 to 3, 7, 8, and 15 to 23, of U.S. Pat. No. 4,103,601 all require costly cutting or stamping operations in their manufacture. In the case where a blade has been roll-formed from sheet metal into a generally hollow tubular shape, such cutting or stamping operations may be difficult, and thus even more expensive to complete. The manufacture of the grille assembly of some embodiments such as illustrated in FIG. 17, may require further operations. For example, the embodiment of FIG. 17 necessitates the bendng over of two tabs 38 to secure a blade in place. Any such additional installation operations further increase the cost of the assembly.

Similarly, the embodiment of FIG. 6 requires a metal support bar to be provided with plastic pins having frictional formations formed thereon. The formation of holes in the metal bar and the insertion of the pins into such holes are expensive operations. Also, the manufacture of frictional formations on the pins (as illustrated both in FIGS. 6 and 14) may require expensive dies. In order to achieve a satisfactory frictional fit, the tolerances for the dimensions of all (there are three illustrated) frictional formations must be carefully controlled.

The same frictional formations of FIGS. 6 and 14 may be subject to significant wear or deterioration when blades are fitted over the formations. Furthermore, the frictional formations increase the necessary blade thickness, thus reducing the free area of the grille through which air may flow. Alternatively, the diameter of the pins may be reduced to allow room for the frictional formations. However, the reduction in pin diameter may result in a loss of pin strength and durability. For these reasons, use of pins with frictional formations may not be desirable.

It is therefore desirable to provide a frictional blade assembly for an air grille in which the means for achieving a tight frictional fit is simple and inexpensive both to manufacture and to install.

BRIEF STATEMENT OF THE INVENTION

This invention is a frictional blade assembly for grilles to be used in association with air ventilation systems wherein said assembly comprises, a first thermoplastic support bar defining a stem, which stem defines a longitudinal axis, and having a plurality of coplanar abutments extending normal to one side of said axis, each of said abutments being more or less the same length and having an outer surface of uniform generally cylindrical shape and having more or less the same diameter, said abutments being formed integrally as part of said support bar, a plurality of blades, each of said blades defining a first end and a second end and being of uniform cross-sectional shape and size along its length, each said blade defining a generally streamline-shaped tube, said tube defining a first edge, a second edge and an internal space, said internal space at said first edge being of generally circular cross-section over an arc of approximately 270°, said circular cross-section having a diameter of between 0.002" and 0.004" less than that of said abutments, said first end of said blades being rotatably attached to respective said abutments by inserting a said abutment into said internal space at the first edge of a said blade, whereby a frictional fit between each said abutment and a respective said blade is obtained, and, a second thermoplastic support bar defining a stem, which stem defines a longitudinal axis, and having a plurality of coplanar abutments extending normal to one side of said axis, said second bar being affixed to said second ends of said blades at said first edges, whereby said blades may be rotated relative to said first and second bars against a frictional resistance.

It is an objective of the invention to provide means for achieving a frictional fit between the blades and the framework of an air grille and which is of reduced diameter to minimise blade thickness and maximise open area for air flow.

It is a further objective of the invention to provide for a frictional blade assembly that is inexpensive and simple to manufacture and install.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
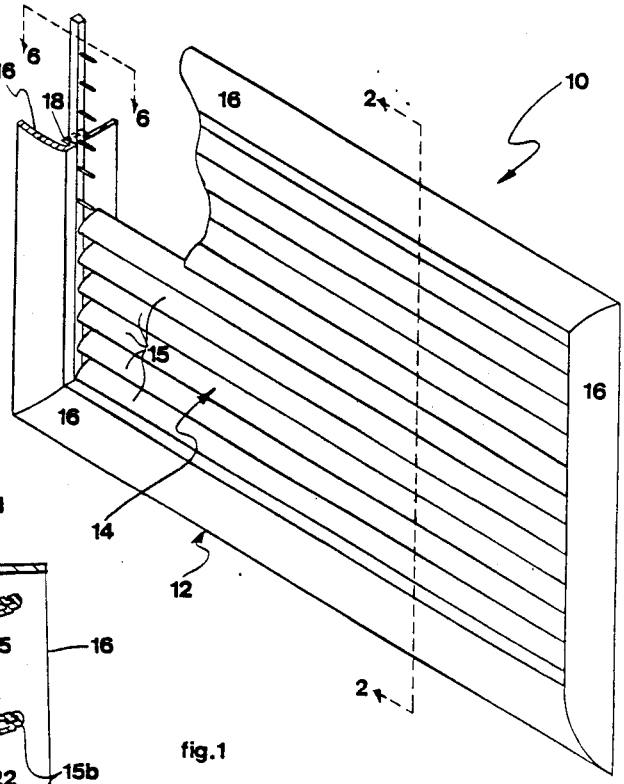
FIG. 1 is a partially cut away perspective view of one embodiment of the invention as it may be used in a complete grille assembly.
Figure 2:
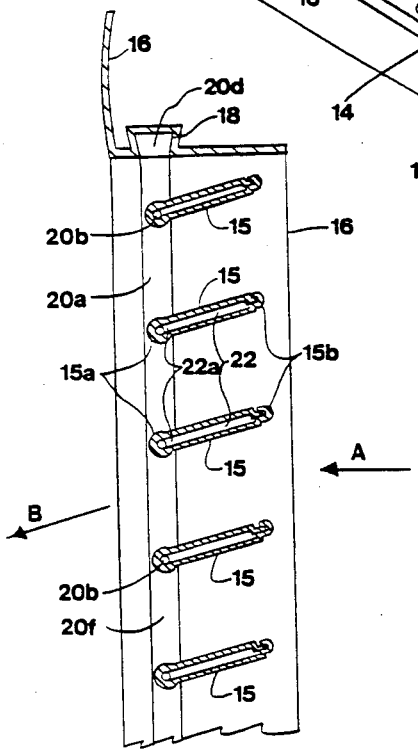
FIG. 2 is a cross-section along the line 2—2 of FIG. 1.

Referring now to FIGS. 1 and 2, there is illustrated a typical grille assembly 10, comprising a rectangularly-shaped grille frame 12 within which is supported frictional blade assembly 14. Grille frame 12 may comprise typical frame members 16, such as are illustrated in FIGS. 1 to 5 of U.S. Pat. No. 4,103,601, held together at its corners in any conventional fashion. Frame members 16 may define a recess 18 within which blade assembly 14 may be supported. Such a recess 18 is preferably trapezoidal in cross-sectional shape, although other shapes may be acceptable. Blade assembly 14 includes a plurality of rotatable, transverse, parallel air deflector blades 15. The angular position of each such blade 15 in operation is fixed with respect to frame members 16. Such angular position may be altered manually or otherwise. The direction of flow of air is changed by blades 15 from the direction indicated by arrow A at the entrance to grille assembly 10 to the direction indicated by arrow B at the exit of grille assembly 10. The angle through which air is deflected is typically less than 20°. Deflection through a greater angle may result in blade vibration or air noise.

Figure 3:
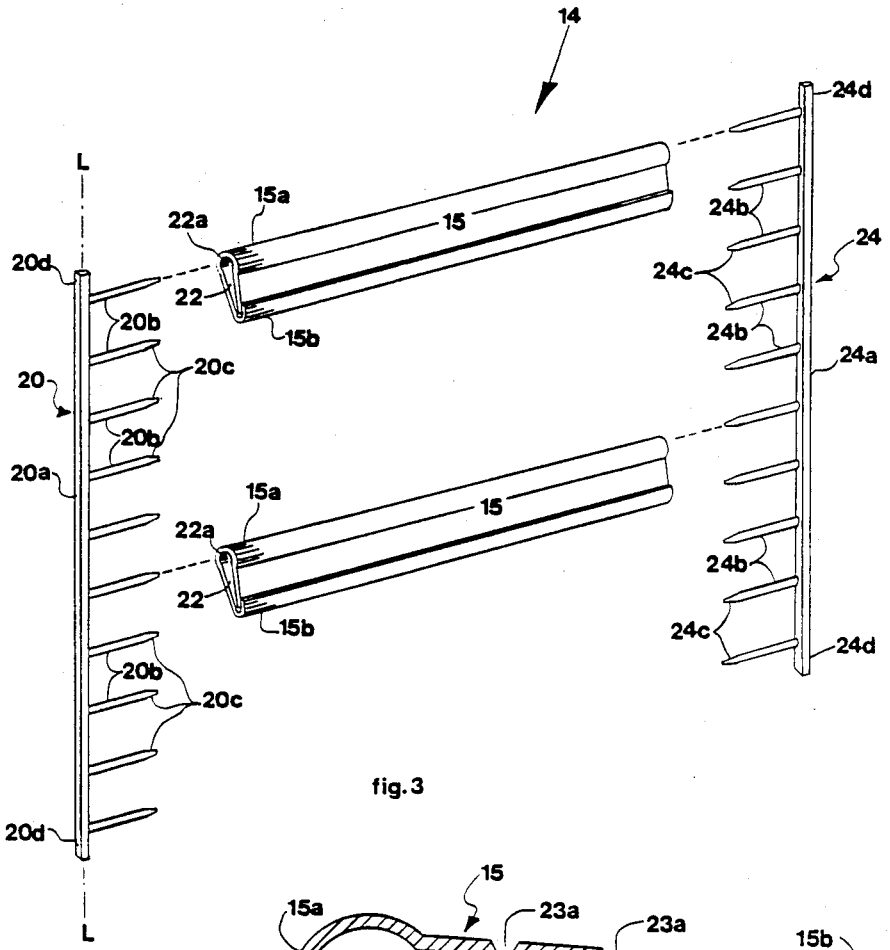
FIG. 3 is an exploded view of a partial frictional blade assembly according to the invention.
Figure 4:
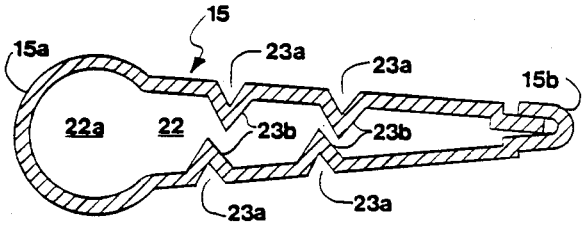
FIG. 4 is a cross-section of one embodiment of an air deflector blade.

Referring to FIG. 3, frictional blade assembly 14 includes a first thermoplastic support bar 20. Support bar 20 defines a stem 20*a* which defines a longitudinal axis L. Support bar 20 further defines a plurality of coplanar abutments 20*b*, extending essentially normal to one side of axis L, and formed integrally with stem 20*a*. Each of abutments 20*b* defines an outer surface of uniform generally cylindrical shape (see FIGS. 6 and 7). Each of abutments 20*b* is of more or less the same length and diameter as all other abutments 20*b*. Each abutment 20*b* defines a tapered free end 20*c*. Free end 20*c* may conveniently be of frusto-conical shape but other shapes may be acceptable. Support bar 20 may further define longitudinal stem extensions 20*d*, which may be used to assist in positioning frictional blade assembly 14 within grille frame 12. Bar 20 may define a surface 20*f* at which abutments 20*b* join stem 20*a*.

Figure 8:
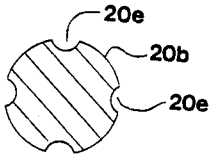
FIG. 8 is a cross-sectional view similar to that shown in FIG. 7 of an alternate embodiment.

In a further embodiment, an abutment 20*b* may define channel means 20*e* extending along the surface of abutment 20*b* (see FIG. 8). Such channel means 20*e* may offer advantages in the event that blades 15 or blade assembly 14 are cleaned, painted or otherwise treated. During operations of this nature, fluid may be trapped within blades 15. If the blade assembly 14 is later subjected to heat, such fluids may be vapourized and pressurized. The pressurization may cause damage to the blade assembly 14. The provision of channel means 20*e* allows fluid and vapour to escape the interior of blades 15 without causing any damage.

Figure 6:
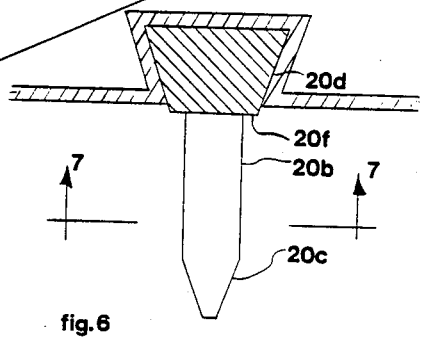
FIG. 6 is a cross-section along the line 6—6 of FIG. 1.
Figure 7:
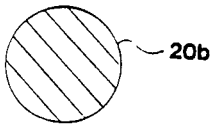
FIG. 7 is a cross-section along the line 7—7 of FIG. 6.

Stem 20*a* and extensions 20*d* may conveniently have a trapezoidal cross-section adapted to dovetail into recess 18 of frame member 16 (see FIG. 6). Other shapes adapted to fit within recess 18 may be acceptable. Stem 20*a* may have sufficient depth so that surface 20*f* is raised above recess 18. Such a configuration conveniently allows surface 20*f* to act as a bearing surface keeping the end of a blade 15 out of contact with frame members 16. Also, in the event that the blade assembly 14 is cleaned, painted or otherwise treated, fluid may escape without restriction by frame members 16.

A plurality of blades 15 are rotatably attached to first thermoplastic support bar 20. Each of blades 15 defines a first end and a second end and is of uniform cross-sectional shape and size along its length. Each blade 15 is formed to define a generally streamline-shaped tube. Each such blade may be generally planar in shape or may be curved, or may be of any shape that is generally known in the art. Each blade 15 defines a first edge 15*a*, a second edge 15*b*, and an internal space 22. The internal surface of first edge 15*a* defines a portion 22*a* of space 22, said portion 22*a*, being a generally circular cross-section over an arc of approximately 270°. Said circular cross-section may conveniently have a diameter of between 0.002" and 0.004" less than that of abutments 20*b*. A blade 15 may define at least one external surface groove 23*a* (see FIG. 4) along its length. Such external grooves 23*a* form internal ridges 23*b*. Such groove 23*a* and ridge 23*b* formations provide blade 15 with additional stiffness and strength.

Figure 5:
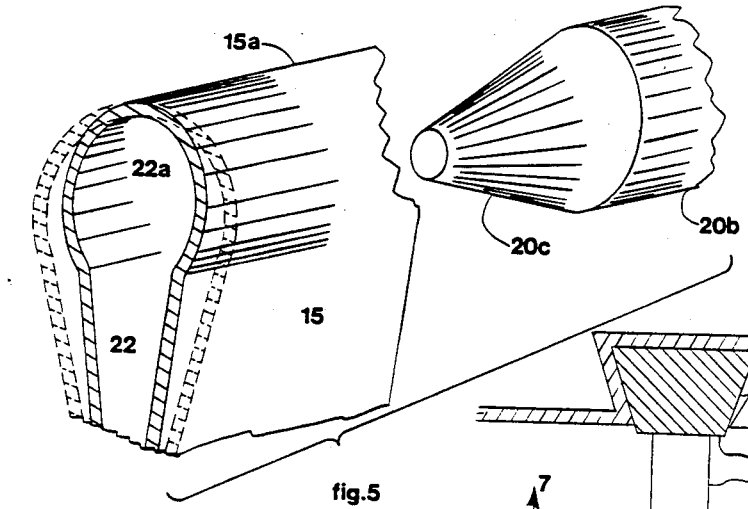
FIG. 5 is a close-up view, in perspective, of the insertion of a supporting abutment into an air deflector blade in one embodiment of the invention.

Blades 15 are rotatably attached to abutments 20*b* by inserting abutments 20*b* into portion 22*a* of space 22 at a same one end of blades 15. The relative diameter of portion 22*a* and of abutment 20*b* and a 270° arc of portion 22*a* ensures that first edge 15*a* acts like a spring clamped around and radially pushing against abutment 20*b*. FIG. 5 illustrates a close up view of an end of blade 15 about to be fitted over abutment 20*b*. The figure in phantom indicates the position of blade 15 when abutment 20*b* is fully inserted into blade 15. The blades 15 are mounted and adjusted so that each blade 15 defines the desired angle with respect to stem 20*a* through which angle air is to be deflected.

The width of a blade 15, that is, the distance between the first edge 15*a* and the second edge 15*b*, corresponds approximately to the distance between abutments 20*b*. Such width may conveniently be within the range 0.490" to 1.010". Conceivably, blades 15 may be rotated to a more or less vertical position to essentially close grille assembly 10 to the flow of air although this would be most unusual. In order that the frictional torque applied to blades 15 is sufficient to resist the torques generated by air pressure at this extreme position, the diameter of abutments 20*b* is preferably between 0.002" and 0.004" greater than that of portion 22*a* of space 20. If more extreme conditions must be met or if blades having a width greater than 1.0" are used, additional frictional forces may be generated by decreasing the diameter of portion 22*a* or by increasing the diameter of abutments 20*b*. The width of blades 15 for use in association with abutments 20*b* of a particular diameter is limited by the fact that blades 15 must be able to maintain a sufficient spring-like clamping action against the abutments 20*b*.

The diameter of abutments 20*b* is limited both by the thickness of the material used in blades 15 and by the amount of free area required to allow air to flow through the grille 10. The maximum free area for air to flow through a grille 10 is available when blades 15 are oriented parallel to the flow of air entering the grille 10. With the blades 15 in such an angular position, air is not deflected by the blades 15 and there is no change in direction of air flow. When the blades 15 are angled with respect to frame 16, there is less area in the grille 10 available for the flow of air. It is possible that the flow of air may be restricted below a predetermined acceptable level.

If the diameter of abutments 20*b* is too great the blades will be too thick. In this case, even when blades 15 are parallel to the air flow, there may be an insufficient flow of air through grille 10 due to the thickness of the blades. Consequently, abutments 20*b* must have a small enough diameter to permit the use of thinner blades and thus allow a satisfactory air flow through grille 10 even at the desired angular orientation of blades 15.

The area available for the flow of air through the grille 10 is further reduced by the thickness of the material used to form blades 15. The thickness of such material must be sufficient to allow blades 15 to the conveniently manufactured and to satisfactorily clamp around abutments 20*b*. Consequently, the combination of abutment diameter and material thickness must define a total blade thickness that will allow a satisfactory air flow through grille 10 at the desired angular orientation of blades 15.

The diameters of abutments 20*b* and the blade material thickness are preferably related to the amount of area of the grille 10 by the following relationship:

$$0.15 \leqq l\frac{(d + 2t)(n + 1)}{A} \leqq 0.4$$

where
- $l$ = blade length
- $d$ = the diameter of abutment 20b
- $t$ = blade material thickness
- $A$ = grille area
- $n$ = number of blades When a longer blade is used, more air pressure torque is applied to the blade. The longer an abutment 20*b* is, the more frictional torque can be generated. Thus, in order to counter the air pressure torque, longer abutments may be used. Preferably, blade lengths are less than or equal to 24" and abutments 20*b* are less than or equal to 1.0" in length exclusive of the length of frustoconical end 20*c*.

The second ends of blades 15 may be rotatably attached to a second thermoplastic support bar 24. Second support bar 24 may be essentially identical to first support bar 20. Second support bar 24 defines abutments 24*b* and stem extensions 24*d*. Abutments 24*b* are inserted into portion 22*a* of space 22 at the second end of each of blades 15. First edge 15*a* acts in a spring-like fashion against abutment 24*b*.

The blades 15 are thus supported between and by support bars 20 and 24. The friction between a blade 15 and its associated abutments 20*b* and 24*b* is sufficient to prevent blade 15 from rotating from its pre-determined desired angular position with respect to frame 16. Yet, such friction is not so great as to prevent such angular position from being manually, or otherwise, adjusted or changed, if desired. Nor is such friction so great as to interfere with the ease of assembly of the frictional blade assembly 14.

In operation, frictional blade assembly 14 is inserted into grille frame 12. This is accomplished by sliding support bar 20 and 24 into recesses 18 in frame members 16. The grille assembly is then installed in the desired air duct. The angular orientation of blades 15 to grille 10 may be manually adjusted to the desired position. The frictional blade assembly 14 will then operate to deflect the flow of air as directed.

Several factors contribute to the success of this invention. First, the materials of the invention and surface finishes of such materials may be selected and prepared to provide suitable frictional resistances to air pressure torques. Thermoplastic polyester (for the support bars 20 and 24) and roll-formed aluminum sheet metal (for the blades 15), both with smooth surface finishes, have a satisfactory coefficient of static friction relative to each other and have been found to be suitable materials to provide acceptable frictional resistance. Preferably, such thermoplastic polyester has between 20 and 30% glass fibre content for added durability and strength. Materials such as POCAN B #4225 or #4235 (trade mark) may be acceptable materials. POCAN B #4225 or #4235 has a coefficient of static friction relative to lapped steel plate of between 0.11 and 0.13. Aluminum has a coefficient of static friction relative to mild steel of between 0.5 and 0.7. Both thermoplastic polyester and aluminum are inexpensive, strong, tough, durable, corrosion-resistant, and light-weight, and thus the frictional blade assembly according to the invention has similar properties and is easy to assemble and install. Other blade materials such as sheet steel, plastic or nylon may be acceptable.

Second, the smooth cylindrical form of abutments 20*b* and 24*b* and the corresponding cylindrical form portion 22*a* of internal space 22 provides a maximum amount of surface area over which frictional forces may be developed. Third, the relative diameters of abutments 20*b* and 24*b* and of portion 22*a* of space 22 (the diameter of abutments 20*b* being preferably between 0.002" and 0.004" greater than that of portion 22*a*) are important to provide satisfactory frictional forces and yet maintain ease of assembly and long life. Fourth, the arc of circular portion 22*a* extending over about 270° is also important to allow first edge 15*a* of blade 15 to act in a spring-like fashion against abutments 20*b* and 24*b*. This provides satisfactory radial forces and corresponding frictional forces between the abutments and the internal surfaces of first edges 15*a*. Fifth, the relationship between the diameter of abutments 20*b* and the width of blades 15 is important to adjust the required frictional forces when different distances between abutments are used and to maintain a suitable grille maximum free area. Sixth, the relationship between abutment length and blade length may be used to adjust the required frictional forces when different blade lengths are used. Seventh, the relationship between abutment diameter to material thickness of blades 15 is important to adjust the strength of the spring-like action of blades 15 against abutments 20*b* and 24*b*. Eighth, the ratio of grille maximum free area to the total grille area is important to ensure a satisfactory flow of air through grille 10 when blades 15 are positioned at the desired angular orientation.

Figure 10:
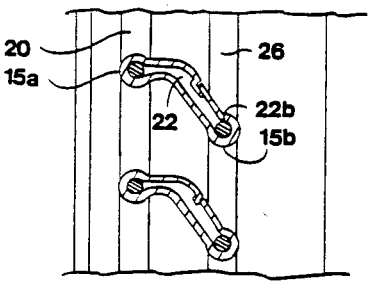
FIG. 10 is a cross-section along the line 9—9 of FIG. 9.
Figure 9:
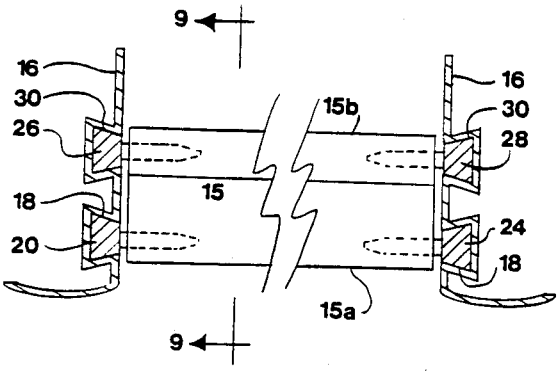
FIG. 9 is a plan view of an alternate embodiment of the invention.

Referring to FIGS. 9 and 10, in a further embodiment, the angular position of blades 15 with respect to frame 12 may be permanently fixed. Such an embodiment may be conveniently used in a return air grille.

The first edge 15*a* of blades 15 are affixed, as in the embodiment described above and illustrated in FIGS. 1 to 8, to first and second thermoplastic support bars 20 and 24. In the embodiment of FIGS. 9 and 10, the second edge 15*b* of blades 15 is affixed to third and fourth thermoplastic support bars 26 and 28 respectively, which may conveniently be essentially identical to support bars 20 and 24. Bars 26 and 28 define stems, stem extensions, and abutments, similar to those of bars 20 and 24.

The internal surface of the second edge 15*b* of each blade 15 defines a portion 22*b* of internal space 22, said portion being of generally circular cross-section over an arc of about 270°. As in the case of the first edge 15*a*, said circular cross-section may conveniently have a diameter of between 0.002" and 0.004" less than that of the abutments of support bars 26 and 28. The abutments of bars 26 and 28 are inserted into portion 22*b*. Such a relationship between the diameters of portion 22*b* and the abutments of bars 26 and 28 ensures that the second edge 15*b* will not vibrate against the abutments and allows for the use of standard parts. All support bars 20, 24, 26 and 28 may conveniently be essentially identical. Thus, manufacturing costs are less than would be the case if the first edge support bars 20 and 24 were different from second edge support bars 26 and 28. However, bars 26 and 28 do not necessarily have to be identical in every respect to bars 20 and 24. It is sufficient if bars 26 and 28 have a shape similar to that of bars 20 and 24 and if bars 26 and 28 are dimensioned to be insertable into said portions 22*b* of internal space 22, whereby to prevent rotation of blades 15 about the abutments of bars 20 and 24.

Frame members 16 define a second recess 30 within which bars 26 and 28 may be supported. As in the case of recess 18, recess 30 is preferably trapezoidal in cross-sectional shape in order to dovetail with the stems of bars 26 and 28.

The abutments of bars 26 and 28 may be vertically offset from abutments 20*b* and 24*b*, respectively, in order to define the specific angle at which blades 15 are to be oriented. Stem extensions on bars 26 and 28 may have to be truncated or cut off, depending on the chosen blade angle.

In a further embodiment, it may be possible to utilize a second support bar 24, defining abutments which act only as pivots for blades 15. In such an embodiment, the first bar 20 is sufficient to retain blades 15 in the desired angular position. Second bar 24 does not assist in preventing rotation of blades 15.

All the above factors permit the manufacture of specific sizes and capacities of grilles to suit many requirements. Yet, the qualities of low cost, durability and simplicity of manufacture and installation are maintained. Thus, the frictional blade assemblies may be manufactured as and when ordered and required. Inventory may therefore be conveniently stored as stacking blades and frame members in standard lengths. The blades are economically formed from strip sheet aluminum by roll forming. Lengths of hollow roll formed blades are saw cut as desired to provide blades having straight-cut ends. The use of blades having straight ends in a blade assembly according to the invention avoids the difficult and costly cutting and notching operations on hollow roll-formed blade stock. Furthermore, cutting of blades and assembly of blade assemblies and grilles may be automated to reduce the amount of handlabour. Such automated assembly procedures may increase the speed of manufacture, thus yielding a faster response to orders.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A frictional blade assembly for grilles to be used in association with air ventilation systems wherein said assembly comprises:

a first thermoplastic support bar defining a stem, which stem defines a longitudinal axis, and having a plurality of coplanar abutments extending essentially normal to one side of said axis, each of said abutments being more or less the same length and having an outer surface of uniform generally cylindrical shape and having more or less the same diameter, and said abutments being formed integrally as part of said support bar;

a plurality of blades, each of said blades defining a first and second ends and upper and lower sides, and being of uniform cross-sectional shape and size along its length, each said blade defining a generally streamline-shaped tube, said tube defining a first edge, a second edge and an internal space, the tube being formed from an integral sheet of relatively thin material whereby the sheet is bent back upon itself and one sheet edge is secured below another, said internal space at said first edge being of generally circular cross-section over an arc of approximately 270°, said circular cross-section having a diameter of between 0.002" and 0.004" less than that of said abutments, said first end of said blades being rotatably attached to respective said abutments by inserting a said abutment into said internal space at the first edge of said blade, whereby a frictional fit between each said abutment and a respective said blade is obtained;

pairs of longitudinal rib means formed along the length of each side of each blade, members of each pair being essentially in opposition to each other and members of at least one pair defining a space therebetween, and, and second thermoplastic support bar defining a stem, which stem defines a longitudinal axis, and having a plurality of coplanar abutments extending essentially normal to one side of said axis, said second bar being affixed to said second ends of said blades at said first edges, whereby said blades may be rotated relative to said first and second bars against a frictional resistance.

2. A frictional blade assembly as claimed in claim 1 wherein said second thermoplastic support bar is essentially indentical to said first support bar.

3. A frictional blade assembly as claimed in claim 2 wherein said blades have a width greater than 0.490" and less than 1.010".

4. A frictional blade assembly as claimed in claim 3 wherein each said abutment defines a tapered free end.

5. A frictional blade assembly as claimed in claim 4 wherein said blades are less than or equal to 24" in length and said abutments are less than or equal to 1.0" in length, said abutment length being exclusive of the length of said tapered free end of said abutment.

6. A frictional blade assembly as claimed in claim 5 wherein said stems of said thermoplastic support bars define stem extension portions extending along said axis from said stems.

7. A frictional blade assembly as claimed in claim 6 wherein said thermoplastic is a thermoplastic polyester containing 20 to 30% glass fibres.

8. A frictional blade assembly as claimed in claim 7 wherein said blades are roll-formed from sheet aluminum, said sheet aluminum being of a pre-determined thickness.

9. A frictional blade assembly as claimed in claim 8 wherein the diameters of said abutments and the said aluminum thickness are related to the amount of total grille area by the following relationship:

$$0.15 \leqq l\frac{(d+2t)(n+1)}{A} \leqq 0.4$$

where
- $l$ = blade length
- $d$ = the diameter of abutment 20b
- $t$ = blade material thickness
- $A$ = grille area
- $n$ = number of blades.

10. A frictional blade assembly as claimed in claim 2 wherein said surface of each of said abutments defines groove means extending along said surface.

11. A frictional blade assembly as claimed in claim 6 wherein said stem extensions define a trapezoidal cross-section.

12. A frictional blade assembly as claimed in claim 4 wherein said tapered free end defines a frusto-conical shape.

13. A frictional blade assembly as claimed in claim 1 wherein said internal space at said second edge of said blades is of generally circular cross-section over an arc of approximately 270° and including third and fourth thermoplastic support bars, each of said third and fourth bars defining a stem, which stem defines a longitudinal axis, and having a plurality of coplanar abutments extending essentially normal to one side of said axis, each said abutment of said third bar being inserted into said internal space at the second edge of a respective said blade at said first end of said blade, each said abutment of said fourth bar being inserted into said internal space at the second edge of a respective said blade at said second end of said blade.

14. A frictional blade assembly as claimed in claim 13 wherein each of said abutments of said third and fourth bars defines a circular cross-section and has a diameter of between 0.002" and 0.004" greater than that of said circular cross-sectional portion of said internal space at said second edge of said blades.

15. A frictional blade assembly as claimed in claim 14 wherein said second, third, and fourth bars are essentially identical to said first bar.

16. A grille assembly for use in association with air ventilation systems wherein said assembly comprises:

a frictional blade assembly, and, a grille frame means in which said blade assembly is supported;

wherein said blade assembly comprises:

a first thermoplastic support bar defining a stem, which stem defines a longitudinal axis, and having a plurality of coplanar abutments extending essentially normal to one side of said axis, each of said abutments being more or less the same length and having a smooth outer surface of uniform cylindrical shape and having more or less the same diameter and defining a tapered free end, said abutments being formed integrally as part of said support bar;

a plurality of blades, each of said blades defining a first and second ends and upper and lower sides, and being of uniform cross-sectional shape and size along its length, each said blade defining a generally streamline-shaped tube, said tube defining a first edge, a second edge and an internal space, the tube being formed from an integral sheet of relatively thin material whereby the sheet is bent back upon itself and one sheet edge is secured below another, said internal space at said first edge being of generally circular cross-section over an arc of approximately 270°, said circular cross-section having a diameter of between 0.002" and 0.004" less than that of said abutments, and said first end of said blades being rotatably attached to respective said abutments by inserting a said sbutment into said internal space at the first edge of said blade, whereby a frictional fit between each said abutment and a respective said blade is obtained;

pairs of longitudinal rib means formed along the length of each side of each blade, members of each pair being essentially in opposition to each other and members of at least one pair defining a space therebetween, and, a second thermoplastic support defining a stem, which stem defines a longitudinal axis, and having a plurality of coplanar abutments extending essentially normal to one side of said axis, said second bar being affixed to said second ends of said blades at said first edges, whereby said blades may be rotated relative to said first and second bars against a frictional resistance.

17. A grille assembly as claimed in claim 16 wherein said second thermoplastic support bar is essentially identical to said first support bar.

18. A grille assembly as claimed in claim 17 wherein said frame means defines a first recess, said recess being adaptable to receive and support said frictional blade assembly.

19. A grille assembly as claimed in claim 18 wherein said stems and said first recess define trapezoidal cross-sections whereby said support bars may be dovetailed into said first recess.

20. A grille assembly as claimed in claim 19 wherein said stem extends outwardly of said recess whereby to define a clearance between said blades and said grille frame means.

21. A grille assembly as claimed in claim 16 wherein said internal space at said second edge of said blades is of generally circular cross-section over an arc of approximately 270° and including third and fourth thermoplastic support bars each of said third and fourth bars defining a stem, which stem defines a longitudinal axis, and having a plurality of coplanar abutments extending essentially normal to one side of said axis, each said abutment of said third bar being inserted into said internal space at the second edge of a respective said blade at said first end of said blade, each said abutment of said fourth bar being inserted into said internal space at the second edge of a respective said blade at said second end of said blade.

22. A grille assembly as claimed in claim 21 wherein said frame means defines first and second recesses, said first recess being adaptable to receive and support said first and second support bars and said second recess being adaptable to receive and support said third and fourth support bars.

23. A grille assembly as claimed in claim 22 wherein said second, third and fourth support bars are essentially identical to said first support bar and wherein said stems and said first and second recesses define trapezoidal cross-sections whereby said support bars may be dovetailed into said first and second recesses.

24. A blade for use in an air ventilation grille, said grille including thermoplastic support bars having a plurality of coplanar abutments of cylindrical shape, said blade defining a first and second end, and being of uniform cross-sectional shape and size along its length, each said blade defining a generally streamline-shaped tube, said tube defining a first edge, a second edge and an internal space, the tube being formed from an integral sheet of relatively thin material whereby the sheet is bent back on itself and one sheet edge is secured below another, said internal space at said first edge being of generally circular cross-section over an arc of approximately 270°, said circular cross-section having a diameter of between 0.002" and 0.004" less than that of said abutments, said first end of said blades being adaptable to be rotatably attached to a said abutment by inserting said abutment into said internal space at the first edge of the blade, whereby a frictional fit between the abutment and the blade is obtained, pairs of longitudinal rib means formed along the length of each side of each blade, members of each pair being essentially in opposition to each other and members of at least one pair defining a space therebetween.

25. A blade as claimed in claim 24 wherein said rib means comprises at least one external groove and internal ridge formation extending along the length of the blade on each side thereof, the said formations on each side defining a space therebetween.

* * * * *